US009883704B2

(12) United States Patent
Duhame

(10) Patent No.: US 9,883,704 B2
(45) **Date of Patent: *Feb. 6, 2018**

(54) IMPACT TRANSFER DEVICE

(71) Applicant: Ronald Duhame, Studio City, CA (US)

(72) Inventor: Ronald Duhame, Studio City, CA (US)

( * ) Notice: Subject to any disclaimer, the term of this patent is extended or adjusted under 35 U.S.C. 154(b) by 639 days.

This patent is subject to a terminal disclaimer.

(21) Appl. No.: 14/217,044

(22) Filed: Mar. 17, 2014

(65) Prior Publication Data

US 2014/0189946 A1 Jul. 10, 2014

Related U.S. Application Data

(63) Continuation of application No. 13/886,153, filed on May 2, 2013, now Pat. No. 8,701,219, which is a continuation of application No. 12/570,236, filed on Sep. 30, 2009, now Pat. No. 8,453,271.

(51) Int. Cl.

| | |
|---|---|
| ***A41D 13/015*** | (2006.01) |
| ***A41D 13/00*** | (2006.01) |
| ***A41D 13/05*** | (2006.01) |

(52) U.S. Cl.

CPC ..... *A41D 13/015* (2013.01); *A41D 13/0002* (2013.01); *A41D 13/0512* (2013.01); *A41D 13/0525* (2013.01)

(58) Field of Classification Search

CPC .. D04B 13/0002; D04B 13/00; D04B 13/015; D04B 13/0512; D04B 13/0525; A41D 13/0002; A41D 13/00; A41D 13/015; A41D 13/0512; A41D 13/0525

USPC ... 2/455, 467, 466, 425, 416, 462, 422, 461; 602/16–18

See application file for complete search history.

(56) References Cited

U.S. PATENT DOCUMENTS

| | | | |
|---|---|---|---|
| 1,532,037 | A | 3/1925 | Robert |
| 1,720,439 | A | 7/1929 | Richardson |
| 3,866,909 | A | 2/1975 | DeSantis |
| 4,577,346 | A | 3/1986 | Hall |
| 5,123,408 | A | 6/1992 | Gaines |
| 5,249,306 | A | 10/1993 | Morris |
| 5,261,125 | A | 11/1993 | Cartwright et al. |
| 5,353,437 | A | 10/1994 | Field et al. |
| 5,362,304 | A | 11/1994 | Varn |
| 5,371,905 | A | 12/1994 | Keim |
| 5,517,699 | A | 5/1996 | Abraham, II |
| 5,566,399 | A | 10/1996 | Cartwright et al. |
| 5,581,820 | A | 12/1996 | Cartwright et al. |
| 5,619,747 | A | 4/1997 | Boisclair et al. |
| 5,853,379 | A | 12/1998 | Ostojic |
| 6,006,368 | A | 12/1999 | Phillips |
| 6,117,096 | A | 9/2000 | Hassard |
| 6,258,013 | B1 | 7/2001 | Dabney |
| 6,322,529 | B1 | 11/2001 | Chung |
| 6,852,087 | B1 | 2/2005 | Dainese |

(Continued)

*Primary Examiner* — Danny Worrell

(74) *Attorney, Agent, or Firm* — Seed IP Law Group LLP

(57) ABSTRACT

An impact transfer device comprising a device body, an impact zone shield associated with a first body region, and at least one body contact associated with a second body region, each body contact comprising at least one contact surface, and at least one attachment structure configured to attach the impact transfer device to a person. At least a portion of a force applied to the impact surface is transferred to the second body region of the person through the contact surfaces.

20 Claims, 7 Drawing Sheets

(56) References Cited

U.S. PATENT DOCUMENTS

| | | | | |
|---|---|---|---|---|
| 6,968,576 | B2 | 11/2005 | McNeil et al. | |
| 7,299,507 | B1 | 11/2007 | Hermoso et al. | |
| 7,430,767 | B2 | 10/2008 | Nagely | |
| 7,941,873 | B2 | 5/2011 | Nagely et al. | |
| 7,958,574 | B1 | 6/2011 | Bodeen et al. | |
| 8,057,415 | B2 | 11/2011 | Hipp et al. | |
| 8,453,271 | B2 | 6/2013 | Duhame | |
| 8,701,219 | B2 * | 4/2014 | Duhame | A41D 13/015 2/455 |
| 2004/0180762 | A1 | 9/2004 | Phillips | |
| 2008/0010730 | A1 | 1/2008 | Twito et al. | |
| 2010/0263111 | A1 | 10/2010 | Leatt et al. | |
| 2011/0072567 | A1 | 3/2011 | Duhame | |

* cited by examiner

IMPACT TRANSFER DEVICE

CROSS-REFERENCE TO RELATED APPLICATIONS

This application is a continuation of U.S. patent application Ser. No. 13/886,153, filed May 2, 2013, which is a continuation of U.S. patent application Ser. No. 12/570,236 filed on Sep. 30, 2009, the specifications of which are hereby incorporated by reference in their entirety.

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE DISCLOSURE

Embodiments of the invention described herein pertain to the field of stunt equipment. More particularly, but not by way of limitation, one or more embodiments of the invention enable an impact transfer device.

BACKGROUND

The film industry is a multi-billion dollar industry. To draw audiences, filmmakers strive to capture realistic scenes on film. Special effects, trained stunt performers and computer generated effects are commonly used to produce a dramatic, convincing enactment of events.

The desire to achieve a realistic scene must be weighed against the safety and skill of the actors in the scene. Stunt doubles are often used, replacing at least one actor with a trained stunt professional for a portion of a scene. A trained stunt person typically has a skill set the actor lacks, allowing him to perform impressive physical feats. A stunt person also has safety training to better avoid injury while performing dangerous tasks. A stunt person may be used when the skill required and the risk of injury is elevated beyond the limitations of an actor. Although a stunt person may be selected and clothed to resemble the actor he is replacing, additional filming and editing techniques are typically used to successfully use two people to portray one character.

Staged combat frequently appears in movies. Typically, physical contact is avoided in the filming of a fight scene to avoid the risk of serious injury. For example, at least one camera may be set up at an angle which conceals the fact that no blow is actually delivered. Because no impact is made when a blow is simulated on film, the actors involved must compensate through their acting. For example, an actor delivering a blow must appear to have struck an object, while the actor receiving the blow must act as if he has been hit. First, the actor receiving a blow must generate a feigned reaction to the simulated blow. The actual reaction of a person to a real blow includes surprise, sudden pain, and involuntary facial and bodily reactions and reflexes. It is highly difficult to simulate the expression of a person who has received a strong blow. An actor must not only emulate these reactions, but he must also perform them at the correct time, even though the actor can only approximate the timing of a blow when no actual contact is made.

Not only must the actors portray immediate and intense reactions such as surprise, severe pain, reflexes, and other involuntary responses, the actors also have to simulate the physics of a real impact. Both actors must move each body part involved in the correct manner and at the correct time. An actual blow may cause movements which are nearly impossible for an actor to simulate using solely the power of his muscles. For example, an actor delivering a blow may be expected to suddenly stop moving upon the perceived impact, while an actor receiving a blow may be expected to fly in the direction of the blow. Furthermore, a blow may cause a recoil or whiplash effect of a specific body part that may be difficult to emulate. The timing, physics, and intensity are exemplary factors which contribute to the difficulty of portraying a realistic impact on film.

In many scenes, such as action scenes involving staged combat, multiple blows are delivered in quick succession. Multiple blows increase the risk of injury and complicate an actor or a stunt person's task of reducing injury to himself. Multiple blows also increase the difficulty of acting for the actor receiving the blows, since the actor must now simulate the timing, physics and reactions of multiple blows. For each blow, the actor is starting at a new position and his various body parts are moving at a new velocity due to the character's conscious movements as well as the character's reaction to previous blows. Furthermore, each blow begins at a unique position, with a unique speed, angle and force.

Although a stunt person may be trained to safely receive a certain amount of force, the risk of injury is often too great to deliver an actual blow to the stunt person. Even the delivery of a direct blow of reduced impact may come with an unreasonable risk of injury, such as a direct force applied to the head, neck and groin. The amount of risk an actor or stunt person is willing to take is determined by the actor or the stunt person and other parties involved in filming. Minimizing or avoiding contact increases the safety of a stunt person or actor receiving a blow, but the realistic appearance of the final product is compromised. Contact helps an actor receiving a blow because it gives the actor information about the timing of a blow. Furthermore, the force of an actual blow will move an actor according to the physics of a blow at the correct time. An actual impact also assists actors by creating a natural reaction to the blow in the actor, whether the actor is delivering or receiving the blow.

There are currently no known systems that provide a wearable impact transfer device which redistributes an impact on a person.

SUMMARY

One or more embodiments described in the disclosure enable an impact transfer device. The impact transfer device comprises a telescoping body with a first end and a second end, an arm coupled to the telescoping body substantially at the first end, an impact zone shield coupled to the impact end of the arm, and at least one body contact coupled with the telescoping body and comprising a contact surface configured to lie against a second body region of the person. The arm has an impact end extending beyond the telescoping body and towards a first body region of a person. Additionally, the arm comprises an extension segment configured to extend the impact end of the arm. The impact zone shield is configured to cover the first body region. Further, the impact zone shield is positioned to receive a blow directed towards the first body region and to transfer at least a portion of force from the blow through the arm and the at least one body contact to the second body region.

Some embodiments of the device further comprise at least one body contact associated with a second body region, wherein the at least one body contact is configured to couple with the device body. In one or more embodiments, the impact transfer device further comprises a mount bar coupled with the device body. At least one body contact is coupled with the mount bar. When the impact transfer device is secured to a person, at least a portion of a force applied to the impact zone shield is transferred to the second body part of the person through the at least one body contact. A contact with the first body part by an object applying the force is avoided.

In one or more embodiments, the impact transfer device further comprises a hinge which couples the device body and the base. The base may further comprise an attachment structure configured to secure the base to a person. In one or more embodiments of the impact transfer device, the attachment structure is a garment. The garment may be one or more pieces, which may be connected by material or separated. At least a portion of the base may be covered by the garment.

In some embodiments, at least one surface of the impact zone shield, the at least one body contact, and the base may all be padded. At least one of a position and an orientation of the arm may be configured to be adjustable with respect to the device body. Furthermore, at least one of a position and an orientation of the impact zone shield may be configured to be adjustable with respect to the arm. At least one of a position and an orientation of the mount bar may be adjustable.

The impact transfer device may further comprise an attachment structure configured to secure the at least one body contact to a person such that a contact surface of each of the at least one body contact faces the person. In one or more embodiments of the impact transfer device, the attachment structure comprises a garment. The garment may be one or more pieces, which may be connected by material or separated. At least a portion of the at least one body contact may be covered by the garment.

In one or more embodiments, the impact transfer device further comprises a trigger configured to generate a signal when an impact is delivered to the impact zone shield and an impact generator configured to generate a force in response to the signal. The impact zone shield may be configured to be positioned to receive a blow directed to a head and neck region of the person. The impact zone shield may also be configured to be positioned to receive a blow directed to a groin region of the person.

One or more embodiments of the impact transfer device comprise two body contacts, each comprising a contact surface configured to be positioned facing a body region below the clavicle of the person.

One or more embodiments described in the disclosure enable an impact transfer device comprising a device body and an impact zone shield configured to couple with the device body. A base is configured to couple with the device body. A mount bar is configured to couple with the device body, wherein the mount bar comprises at least one contact surface coupled with the mount bar. The device further comprises at least one attachment structure configured to attach the impact transfer device to a person. At least a portion of a force applied to the impact surface is transferred to the person at the at least one contact surface.

BRIEF DESCRIPTION OF THE DRAWING

The above and other aspects, features and advantages of the invention will be more apparent from the following more particular description thereof, presented in conjunction with the following drawings wherein.

DETAILED DESCRIPTION

An impact transfer device will now be described. In the following exemplary description, numerous specific details are set forth in order to provide a more thorough understanding of the embodiments of the impact transfer device described in the disclosure. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
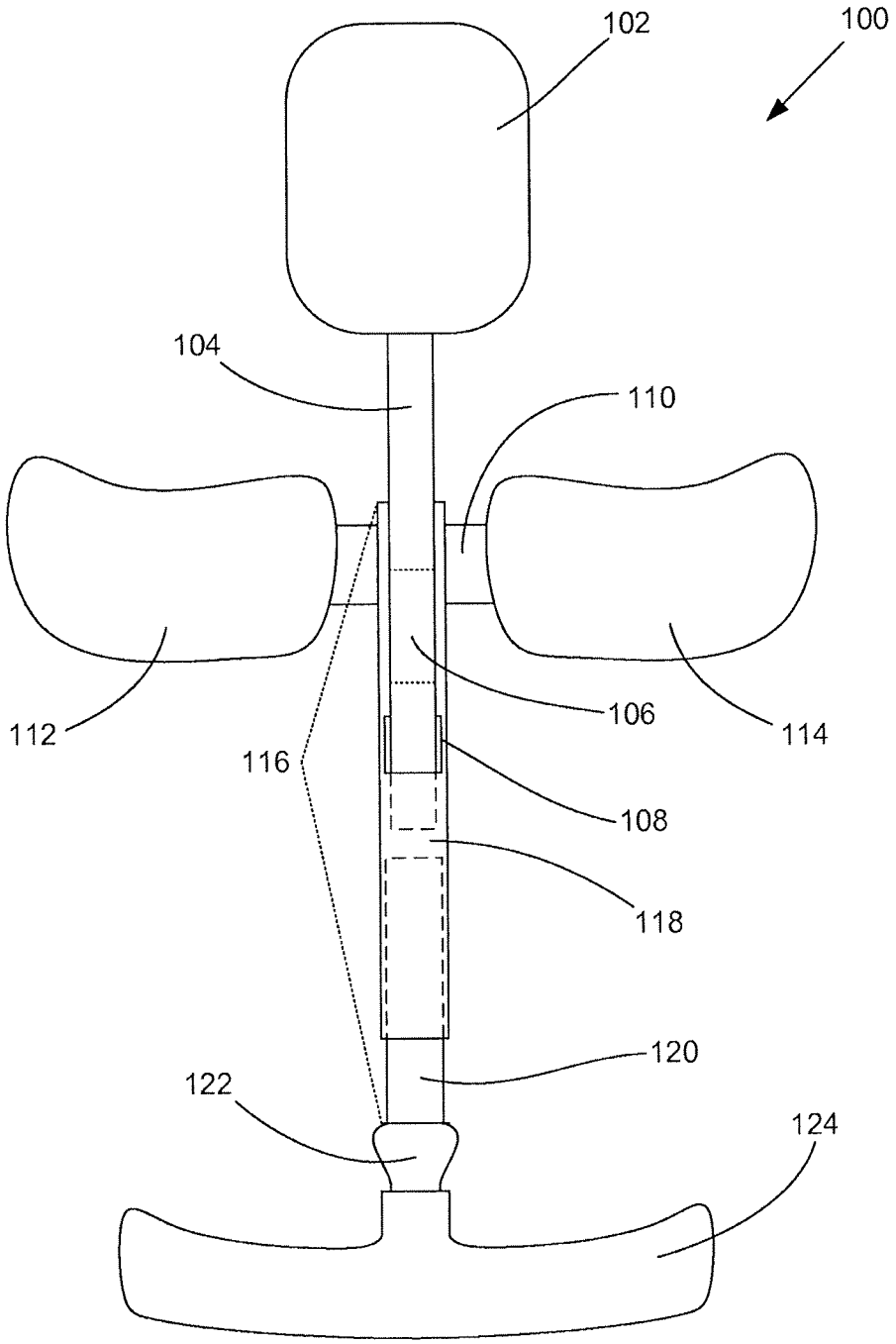
FIG. 1 is a front view of an exemplary embodiment of the impact transfer device described in this application.
Figure 2:
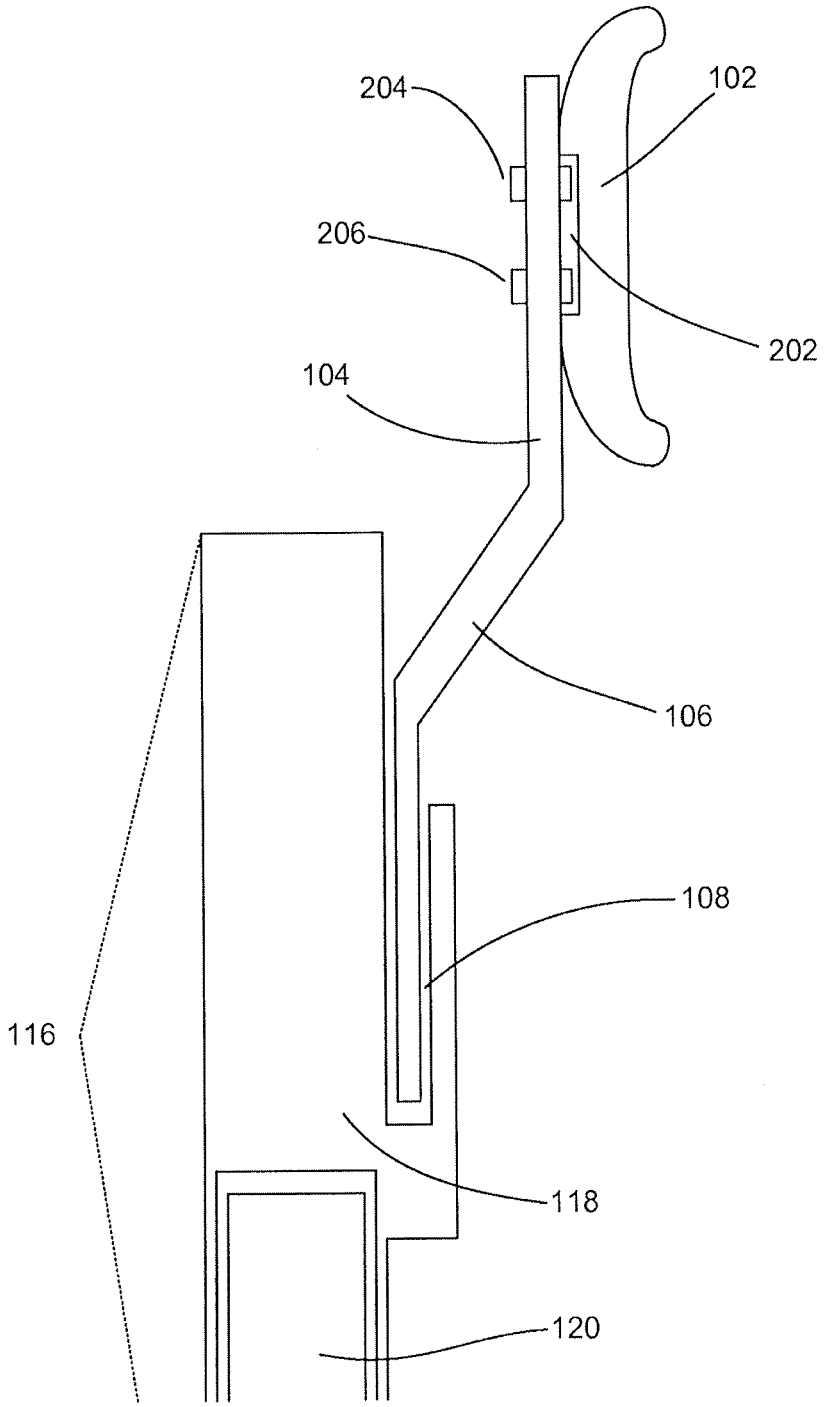
FIG. 2 is a side view of an exemplary embodiment of the impact transfer device described in this application.

FIGS. 1-2 illustrate an exemplary embodiment of the impact transfer device described in this application. Impact transfer device 100 comprises impact zone shield 102. Impact zone shield 102 is any surface suitable for receiving an impact. In one or more embodiments of the impact transfer device, impact zone shield 102 has a padded surface to reduce the risk of injury or to increase the comfort of a person delivering a blow to impact zone shield 102. Impact zone shield 102 may comprise a curved surface to accommodate different blow angles. The size, shape and curvature of impact zone shield 102 may be configured to accommodate different blow sources. For example, a smaller concave surface may be used for blows delivered by fist, while a larger concave surface may be used for blows delivered by foot. A flat or convex surface may be used for blows delivered by an object, including an object wielded by a person. Alternatively, impact zone shield 102 may comprise a shape suitable for receiving a wide variety of blows.

Impact zone shield 102 is coupled with arm 104 by any coupling means. For example, impact zone shield 102 may be coupled with arm 104 by one or more fasteners 204-206, such as nuts, bolts, screws, washers, pins, or any other fastener. In one or more embodiments of the impact transfer device, the position and orientation of impact zone shield 102 is adjustable to optimally position impact zone shield 102 for a specific blow. As used herein, the "orientation" of an object refers to an angle of the object with respect to a point of attachment. As used herein, the "position" of an object refers to the location of a point of attachment of the object. Adjustments may be made using pins, screws, nuts, sockets, or any other means of adjustably securing impact zone shield 102 to arm 104. Impact zone shield 102 may be configured to couple with arm 104 in one or more fixed positions or orientations. Impact zone shield 102 may be movably coupled with arm 104 such that impact zone shield 102 has a small degree of freedom of movement with respect to arm 104. Impact zone shield 102 may further comprise at least one attachment plate 202 for receiving at least one fastener 204-206. Impact zone shield 102 may also couple with arm 104 using an adhesive. Impact zone shield 102 may also comprise a fitted recess for receiving arm 104.

Arm 104 comprises extension segment 106. When arm 104 is coupled with telescoping body 116 and impact zone shield 102, extension segment 106 extends the end of arm 104 coupled with impact zone shield 102 away from the axis of telescoping body 116. Thus, when impact transfer device 100 is worn by a person, extension segment 106 creates distance between impact zone shield 102 and the person's body. Although arm 104 is shown with extension segment 106, one of ordinary skill in the art would appreciate that any bend or curvature of arm 104 in the direction of extension segment 106 would achieve the same effect. Arm 104 may comprise any material capable of withstanding a force applied to impact zone shield 102, such as steel, titanium, aluminum, any other metal or alloy, a resin, acrylic, a plastic, a plastic composite or any other material. The material of arm 104 may be selected based on desirable properties for a particular use of the impact transfer device, such as hardness, flexibility, tensile strength, yield strength, brittleness, and other properties of a material.

Arm 104 couples with telescoping body 116 at arm support 108. In one or more embodiments of the invention, arm support 108 comprises a slot configured to receive an end of arm 104. Although slot 104 is shown protruding from telescoping body 116, arm support 108 may comprise a slot fully integrated into telescoping body 116. Arm 104 may be coupled with telescoping body by one or more fasteners 204-206, such as nuts, bolts, screws, washers, pins, or any other fastener. Arm 104 may be rotatably coupled with telescoping body 116 such that arm 104 may be positioned at two or more orientations with respect to a pivot point at which arm 104 and telescoping body 116 are coupled. Arm 104 may be movably coupled with telescoping body 116 such that the vertical position of arm 104 is adjustable to two or more positions along the length of telescoping body 116. In one or more embodiments, arm 104 is manufactured as an extension of telescoping body 116, rendering a separate coupling means unnecessary.

Telescoping body 116 comprises at least two telescoping sections such that the length of telescoping body is adjustable. Although telescoping body 116 allows impact transfer device 100 to adjust to the height and movement of a person wearing impact transfer device 100, a non-telescoping body may be used without departing from the spirit of the invention. In one or more embodiments, telescoping body 116 comprises sleeve 118 and rod 120. Sleeve 118 is configured to receive rod 120. Sleeve 118 may move in both directions along the axis of rod 120. Rod 120 and sleeve 118 may be either substantially straight or slightly curved, as long as an overlapping portion of rod 120 and sleeve 118 have the same curvature such that sleeve 118 may slide over rod 120. The cross sections of rod 120 and sleeve 118 may be circular, rectangular, or any other shape. In one or more embodiments, the perimeter of the outer surface of rod 120 is substantially equal in size to the perimeter of the inner surface of sleeve 118 to create frictional resistance between rod 120 and sleeve 118. Rod 120 and sleeve 118 may optionally comprise rims configured to retain rod 120 in sleeve 118, or any other means for retaining rod 120 in sleeve 118. Components of telescoping body 116, such as rod 120 and sleeve 118, may comprise any material capable of withstanding the forces applied to telescoping body 116, such as steel, titanium, aluminum, any other metal or alloy, a resin, acrylic, a plastic, a plastic composite or any other material.

Impact transfer device 100 further comprises at least one body contact 112-114. Each body contact 112-114 comprises a contact surface configured to lie against the surface of a person wearing impact transfer device 100. Body contacts 112-114 are coupled with telescoping body 116. In one or more embodiments, body pads 112-114 are coupled with mount bar 110, and mount bar 110 is coupled with telescoping body 116. In one or more embodiments, body contacts 112-114 are manufactured as integral components of mount bar 110, rendering a separate coupling means unnecessary. In one or more embodiments of the impact transfer device, the position and orientation of mount bar 110 is adjustable. Body contacts 112-114 may be fixedly coupled with telescoping body 116. In one or more embodiments, body contacts 112-114 are movably coupled with telescoping body 116 such that body contacts 112-114 have a small degree of freedom of movement in rotation, allowing the contact surface of body contacts 112-114 to lie flush with the surface of a person wearing an impact transfer device.

Force applied to impact zone shield 102 is transferred along arm 104 and telescoping body 116 to body contacts 112-114. In one or more embodiments, the contact surfaces of body contacts 112-114 are shaped to conform to a specific region of the body. Body contacts 112-114 may be configured to transfer and distribute force to a body in a way which minimizes a risk of injury to a person wearing the impact transfer device. In an exemplary embodiment, at least one body contact is configured to contact a person wearing the impact transfer device below the clavicle. The contact surface of body contacts 112-114 may be padded to provide additional comfort for a person wearing impact transfer device 100 or to further reduce the risk of injury from the blow.

In one or more embodiments, impact zone shield 102 is positioned to receive a blow directed toward a first body region and transfer the force to a second body region in contact with body contacts 112-114. As used herein, the term "body region" may refer to either a single body part (i.e., face, pelvis, and the like), a set of adjacent body parts (i.e., face and neck, pelvis and abdomen, and the like), or non-adjacent body parts (i.e., left shoulder and right shoulder, thigh and abdomen, and the like). The term "body region" may also refer to a general region, such as torso, upper body, lower body, or any other region.

By transferring the force of the impact directed toward the first body region to the second body region, impact transfer device 100 creates a natural reaction in a person wearing the device, thereby creating a more realistic simulation of a real-life impact to the body. The transferred force is capable of creating an involuntary reaction and an involuntary movement. The involuntary reaction and the involuntary movement also gives the person wearing the device an idea of the nature of the simulated blow. The person wearing the device can use this information to further enhance the person's simulation of receiving the blow to the first body region. Furthermore, the transferred force provides a cue regarding the timing of the impact to the person wearing the device.

Figure 7:
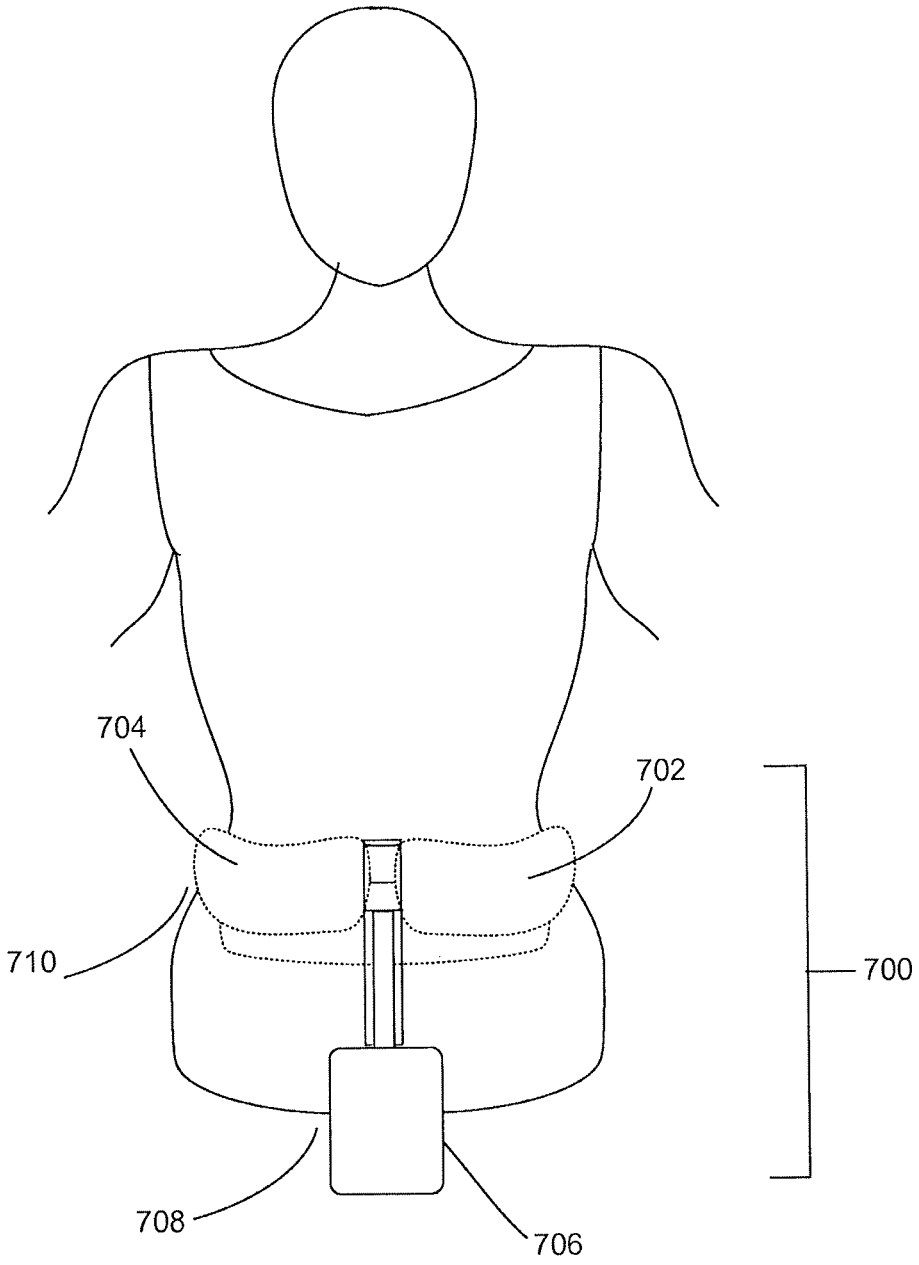
FIG. 7 illustrates an exemplary embodiment of the impact transfer device described in this application.

The first body region may correspond with one or more sensitive body parts, such as the face, neck or groin. The second body region is typically a region which can withstand a force with a smaller risk of injury to a person receiving the blow. The first body region and the second body region may be selected such that the transferred force from a blow to the impact zone shield will move a person wearing the impact transfer device in the same direction and manner as an actual blow to the first body region to properly simulate the physics of the blow. For example, when a location below the clavicle is chosen as the second body region and the head or neck is chosen as the first body region, an impact delivered to impact zone shield 102 will move a wearer's head and torso in a realistic manner. The first body region and the second body region may also be selected such that a person wearing the device experiences a similar natural reaction as a blow to the first body region. For example, as shown in exemplary impact transfer device 700 of FIG. 7, when the first body region 708 is the groin and the second body region 710 is the abdomen, the wearer will feel compelled to double over when a blow is delivered to impact zone shield 706 via body contacts 702-704.

Impact transfer device 100 further comprises base 124. Base 124 is coupled with telescoping body 116 by hinge 122. Base 124 is configured to contact a body part of a person wearing impact transfer device 100. Although base 124 is shown at about the pelvic bone in the example, base 124 may be located on a different part of the body. Base 124 is configured to provide an additional contact point with the body for support and stability of impact transfer device 100. In one or more embodiments of the impact transfer device, base 124 is padded to increase the comfort of a person wearing impact transfer device 100.

Optional hinge 122 allows telescoping body 116 to rotate with respect to base 124. Hinge 122 allows impact transfer device 100 to move with a person wearing the device when rotational movement is expected between body contacts 112-114 and base 124. In one or more embodiments, hinge 122 is a one-way hinge, allowing telescoping body 116 to rotate in one direction with respect to base 124. Hinge 122 may comprise a releasably locking hinge wherein telescoping body 116 may be configured to either rotate or lock with respect to base 124.

Figure 3:
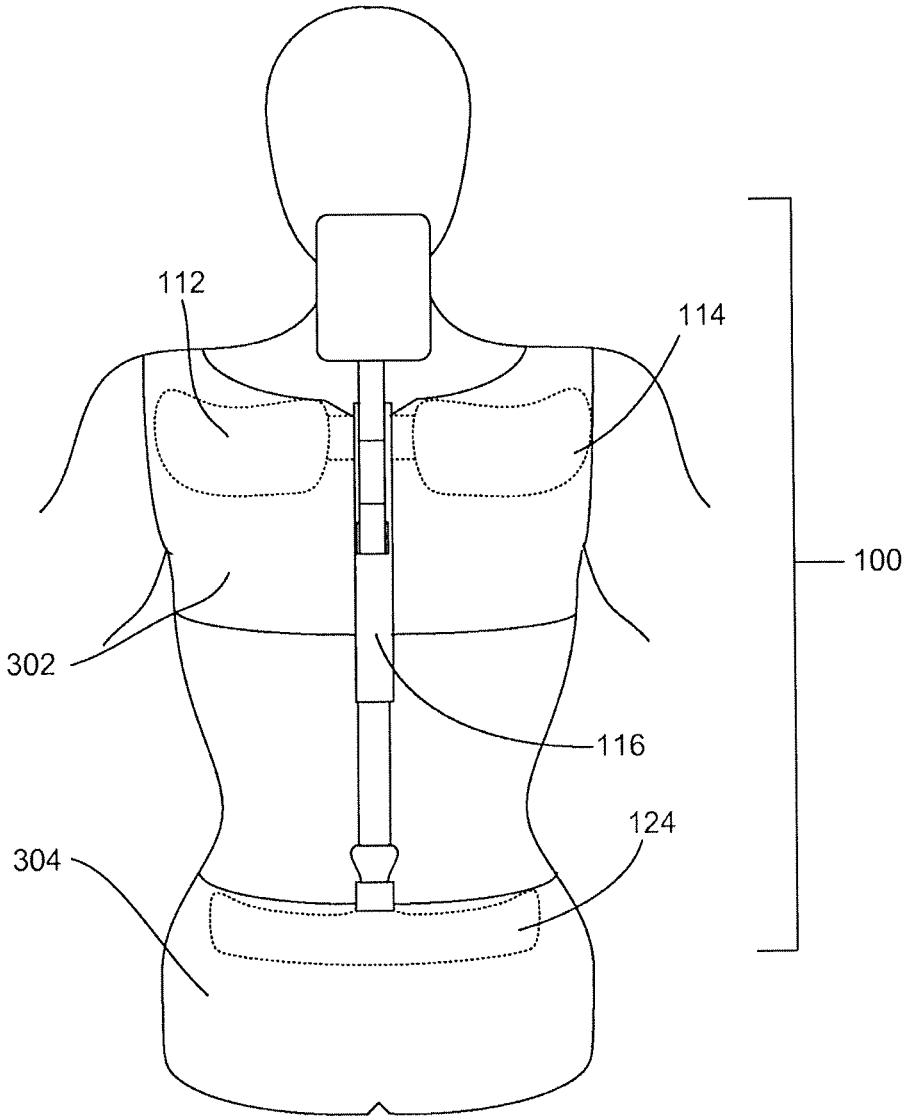
FIG. 3 is a front view of an exemplary embodiment of the impact transfer device described in this application.

FIG. 3 illustrates an exemplary embodiment of impact transfer device integrated in a wearable garment. Upper garment 302 is coupled with at least a portion of telescoping body 116. Although telescoping body 116 is shown on the exterior of upper garment 302, all or part of telescoping body 116 may be disposed over, under or between layers of upper garment 302. Upper garment 302 is also coupled with body contacts 112-114. Although body contacts 112-114 are shown on the interior of upper garment 302, body contacts 112-114 may be disposed over, under or between layers of upper garment 302. Upper garment 302 is configured to hold telescoping body 116 and body contacts 112-114 against the body of a person wearing upper garment 302. Upper garment 302 may further comprise a means for allowing entry or securing upper garment 302 to the wearer, such as a zipper, lacing, straps, buckles, or any other method of securing upper garment 302 to the wearer.

Lower garment 304 is coupled with at least a portion of base 124. Although base 124 is shown on the interior of lower garment 304, base 124 may be disposed over, under or between layers of lower garment 304. Lower garment 304 is configured to hold telescoping body 116 and base 124 against the body of a person wearing lower garment 304. Lower garment 304 may further comprise a means for allowing entry or securing lower garment 304 to the wearer, such as a zipper, lacing, straps, buckles, or any other method of securing lower garment 304 to the wearer.

Although a two-piece suit comprising upper garment 302 and lower garment 304 is illustrated, one of ordinary skill in the art would appreciate that a two-piece suit is one of many articles which are usable to attach a person to impact transfer device 100, and that any article which secures base 124 and at least one of a portion of telescoping body 116 or body contacts 112-114 to a wearer is suitable. For example, upper garment 302 and lower garment 304 may be connected to form a one-piece garment. An article used to secure impact transfer device 100 to a wearer may comprise at least one reinforced section. An article used to secure impact transfer device 100 to a wearer may further comprise a means for allowing entry and securing the article to the wearer, such as a zipper, lacing, straps, buckles, or any other method of securing lower garment 304 to the wearer.

In one or more embodiments, impact transfer device 100 is directly coupled to a securing means for securing impact transfer device to a wearer, such as straps, buckles, lacing, grommets, or any other securing means, rendering a garment unnecessary. In one or more embodiments, base 124 is replaced by at least one strap, buckle, lace, grommet, or other securing means, wherein the securing means effectively replaces base 124. In one or more embodiments of the impact transfer device, at least a portion of impact transfer device 100 is configured to be easily concealed under clothing. A portion of impact transfer device 100 may be constructed of transparent material or otherwise configured to be easily concealable in a filmed scene. At least a portion of a surface of impact transfer device 100 may be colored green, blue or any other color which facilitates video editing to remove images of impact transfer device 100 from a final video product.

Figure 4B:
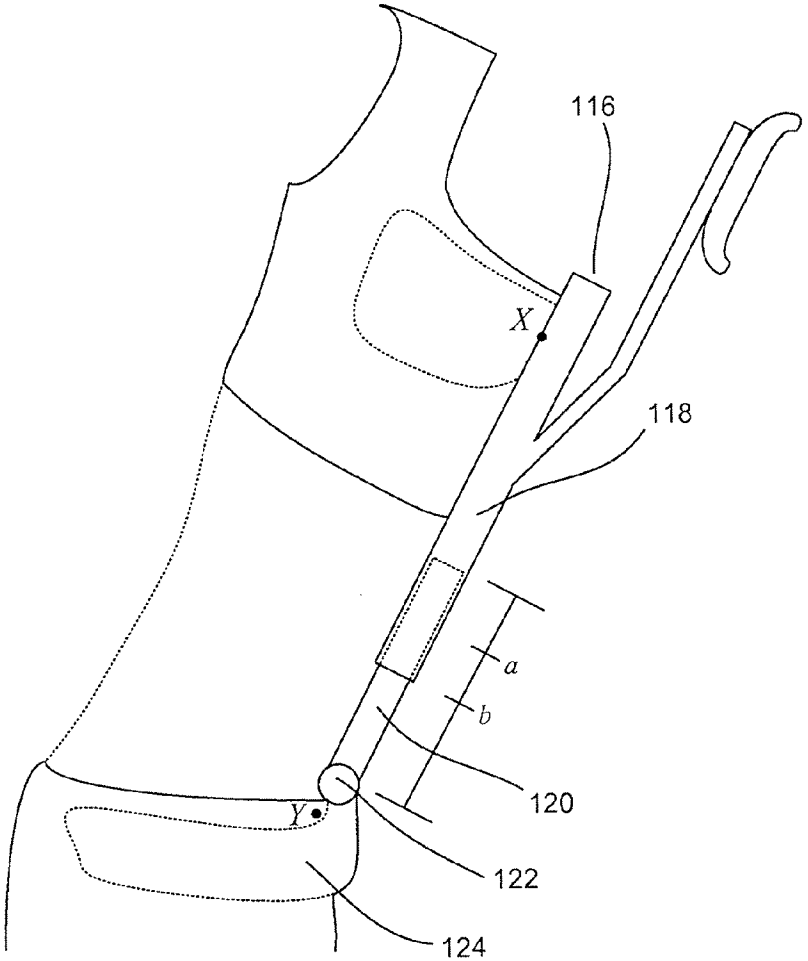
FIGS. 4A-B are side views of an exemplary embodiment of the impact transfer device described in this application.
Figure 4A:
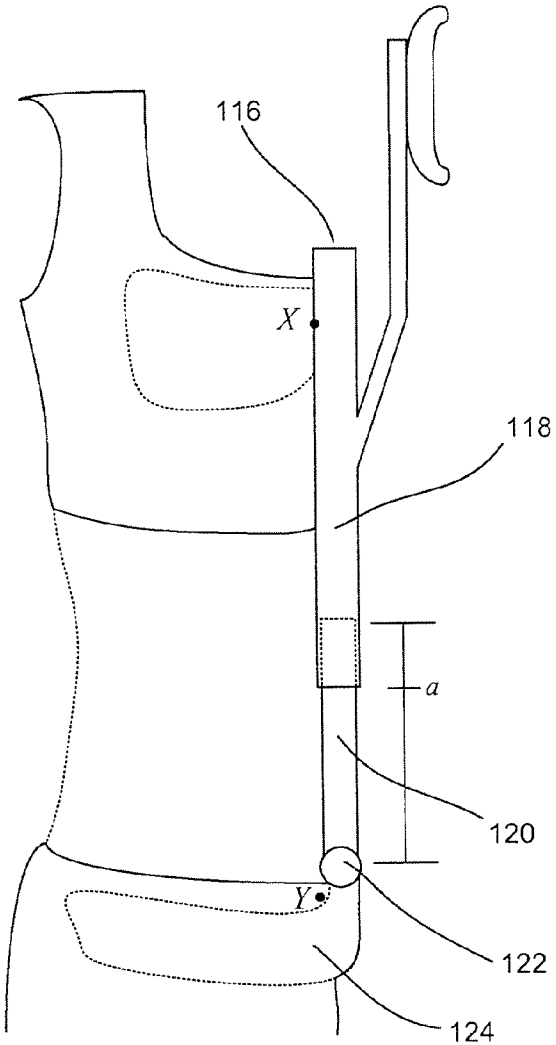

FIGS. 4A-B are side views of an exemplary embodiment of the impact transfer device described in this application. As a person moves, the distance between a point X on the upper torso and a point Y on the lower torso does not remain constant. Telescoping body 116 adjusts so that impact transfer device 100 accommodates such movement. FIG. 4A illustrates impact transfer device 100 worn by a person standing upright. Sleeve 118 is freely movable on rod 120. A portion of rod 120 is inside sleeve 118. At a standing position, rod 120 enters sleeve 118 at a distance from hinge 122.

FIG. 4B illustrates impact transfer device 100 worn by a person bending at the waist. Base 124 remains in position while telescoping rod 116 moves with the torso of the person, rotating at hinge 122. When a person wearing impact transfer device 100 bends at the waist, the distance between point X on the upper torso and point Y on the lower torso is typically shortened. Telescoping body 116 adjusts such that a greater portion of rod 120 is inside sleeve 118. At the position shown, rod 120 enters sleeve 118 at a distance b from hinge 122.

Although telescoping body 116 allows impact transfer device 100 to adjust to the height and movement of a person wearing impact transfer device 100 as shown in FIGS. 4A-B, a non-telescoping body may be used in impact transfer device 100 without departing from the spirit of the invention. Telescoping body 116 may allow impact transfer device 100 to fit a range of persons of different size. In one or more embodiments, at least one component of impact transfer device 100 can be swapped with a component of a different shape or size to customize the fit of impact transfer device 100 to a person or to a specific body part.

Figure 5B:
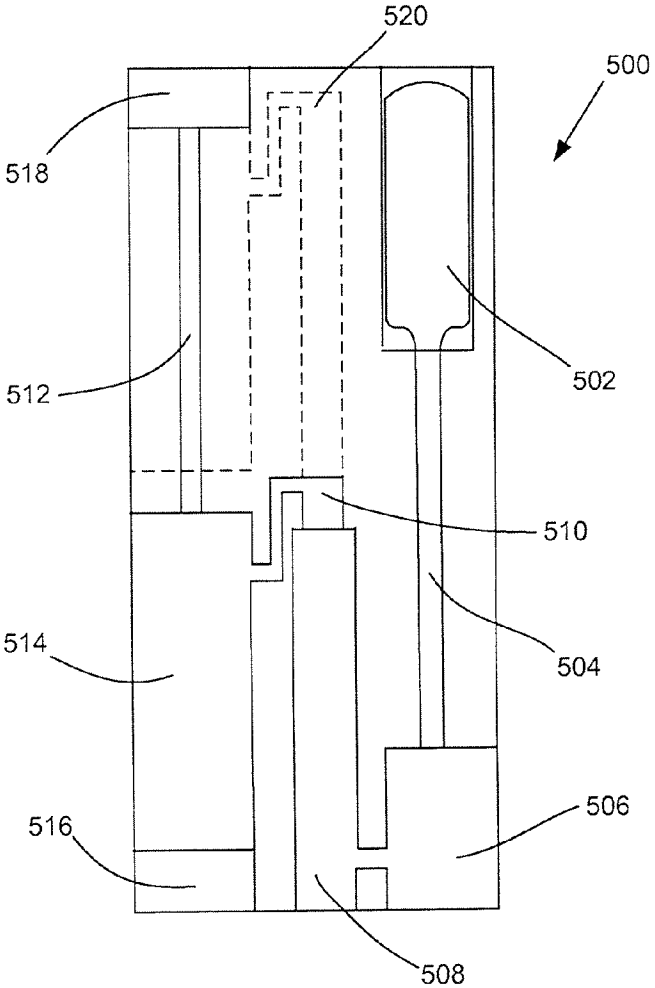
FIGS. 5A-B illustrate an exemplary embodiment of an impact generator for the impact transfer device described in this application.
Figure 5A:
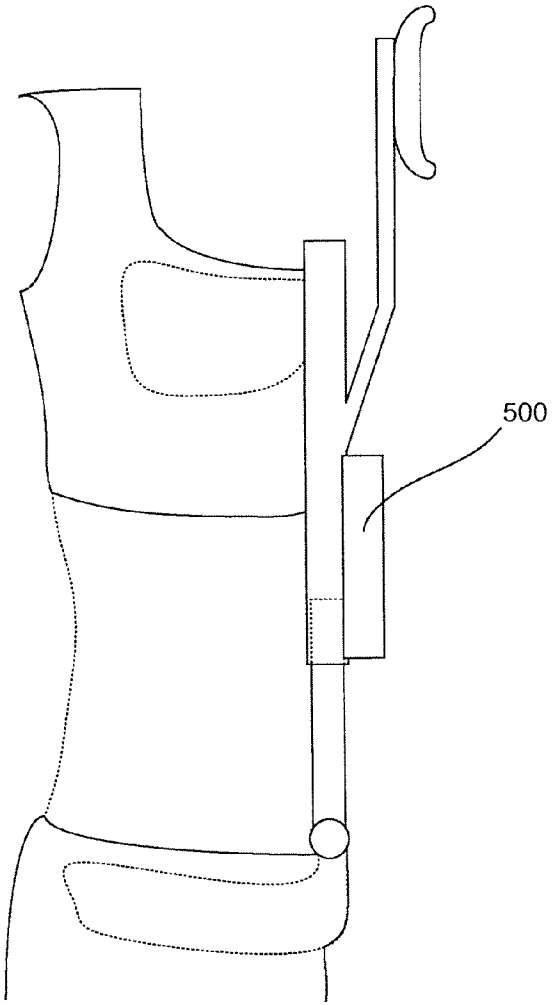

FIGS. 5A-B illustrate an exemplary embodiment of an impact generator for the impact transfer device described in this application. As shown in FIG. 5A, impact generator 500 may be coupled directly to impact transfer device 100. Impact generator 500 may also be coupled directly to any part of the body of a person wearing impact transfer device 100. When impact generator 500 is triggered, impact generator 500 generates an additional force. The positioning of impact generator 500 and the force generated by impact generator 500 may be tailored to assist an actor with the timing, movement and/or expression comprising a reaction to an impact delivered to impact zone shield 102. In one or more embodiments, impact generator 500 is configured to deliver an electric shock, a mechanical stimulus, or any other cue.

FIG. 5B illustrates an exemplary impact generator 500 which may be used. A person of ordinary skill in the art will appreciate that impact generator 500 generates an impact through one of many methods known in the art for generating an impact, and that any of the methods known in the art may be used as an element of impact transfer device 100 as described in this disclosure. Impact generator 500 comprises air cartridge 502. Air cartridge 502 is one example of an energy source for generating an impact. Air from air cartridge 502 travels through air channel 504 to control device 506. Other suitable energy sources may include a loaded spring, a motor, an electric charge, or any other means of providing energy to generate an impact. More than one suitable energy source may be used in impact generator 500.

Control device 506 determines when an impact will be generated. In one or more embodiments of the invention, control device 506 is linked to a trigger. The trigger may be activated by a force applied to impact zone shield 102. The trigger may also be a motion sensor configured to recognize a sudden motion such as a motion caused by the application of force to impact zone shield 102. The trigger may be directly linked to control device 506 or wirelessly linked by a wireless signal, such as a radio frequency, infrared, Bluetooth, or any other wireless frequency signal.

Control device 506 activates the transfer of energy such as the compressed air in air cartridge 502 to an impact generating element such as piston 508. In the illustrated example, control device 506 allows the compressed air from air cartridge 502 to move piston 508. The compressed air causes piston 508 and attached weight 514 to travel to position 520. Attached weight 514 moves along guide rod 512 between impact plates 516-518. The movement of attached weight 514 and piston 508 is stopped by impact plate 518, and an impact is generated upon the contact of attached weight 514 with impact plate 518. In one or more embodiments, at least one secondary impact is generated by impact generator 500 after control device 506 is triggered. For example, in the illustrated example, a second impact may be generated when weight 514 returns towards and collides with impact plate 516. In one or more embodiments, impact generator 500 uses a pneumatic piston or another generated force to drive a weighted object, such as weight 514, along a fixed guided path. The fixed guided path may be defined by a linear or curved guide, such as guide rod 512. Alternatively, the fixed guided path of weight 514 may be defined by a pivot point.

Figure 6:
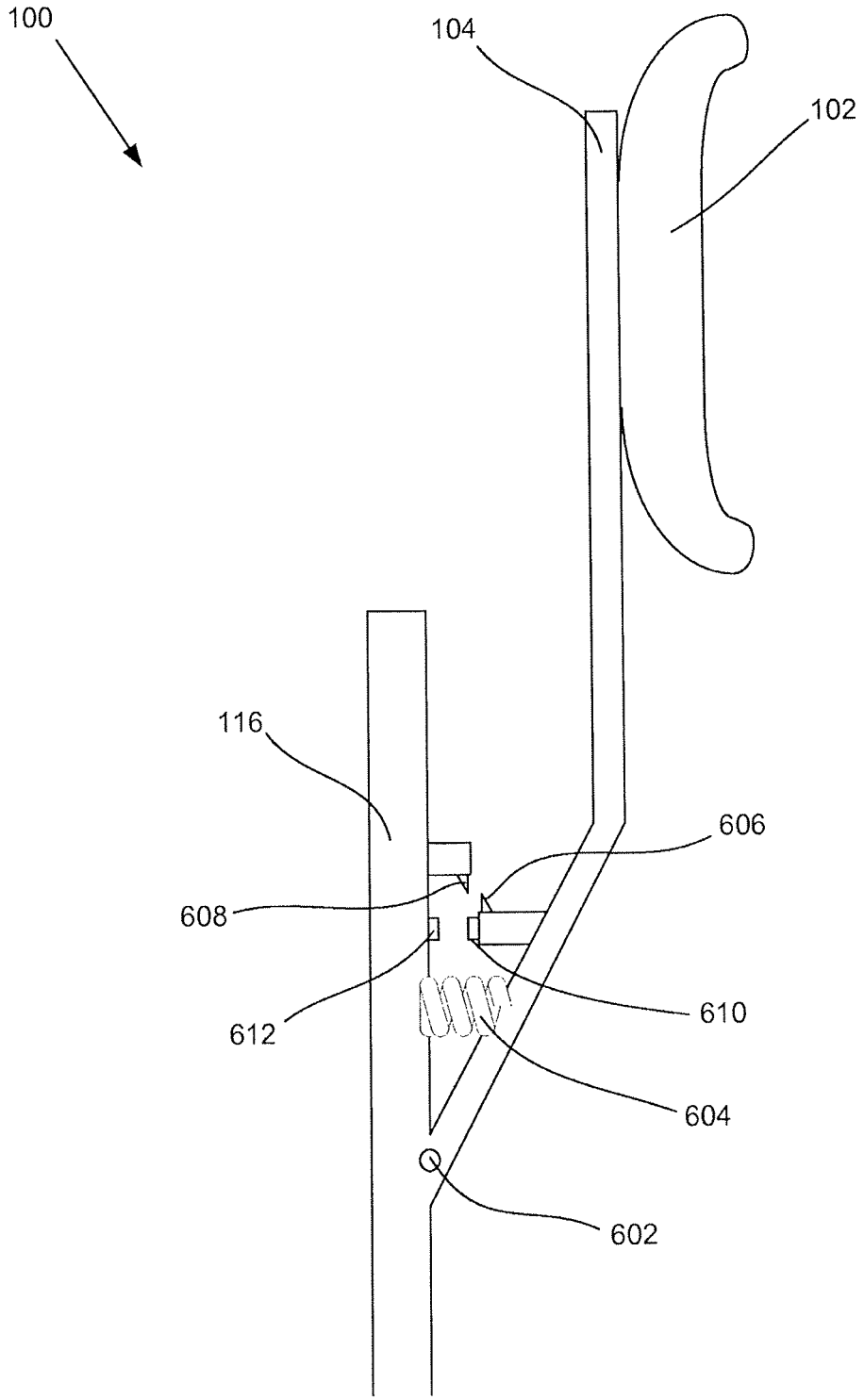
FIG. 6 illustrate a detailed view of a portion of an exemplary embodiment of the impact transfer device described in this application.

FIG. 6 illustrates a detailed view of an exemplary embodiment of the impact transfer device described in this application. Trigger plates 610-612 demonstrate one example of a trigger for activating control device 506 of impact device 500. When an impact is applied to impact zone shield 102, arm 104 moves toward device body 116. Trigger plates 610-612 may be coupled with control device 506 wirelessly or by wire running on the surface of or inside impact transfer device 100.

Arm 104 may be manufactured as an extension of device body 116 such that arm 104 and device body 116 comprise a single piece. In one or more embodiments, arm 104 is rotatably coupled with device body 116 by hinge 602. Impact transfer device 100 may further comprise support mechanism 604. Support mechanism 604 may be employed to position arm 104 at a set position with respect to device body 116. Support mechanism 604 may provide resistance against the rotational movement of arm 104 toward device body 116 at hinge 602 when an impact is applied to impact zone shield 102.

Impact transfer device 100 may further comprise at least one snap action component 606-608. When an impact is applied to impact zone shield 102, the at least one snap action component 606-608 is pushed against a surface, building tension until the snap action component 606-608 moves past the surface. When the snap action component 606-608 is released, a snap impact is produced. Each snap action component 606-608 may be configured to push against a surface provided on impact generating device 100, including another snap action component 606-608. The configuration and positioning of the at least one snap action component 606-608 may be tailored to assist an actor with the timing, movement and/or expression comprising a reaction to an impact delivered to impact zone shield 102.

While the impact transfer device herein disclosed has been described by means of specific embodiments and applications thereof, numerous modifications and variations could be made thereto by those skilled in the art without departing from the scope set forth in the claims.

What is claimed:

1. An impact transfer device comprising:

a telescoping body with a first end and a second end;

an arm coupled to the telescoping body substantially at the first end, the arm having an impact end extending beyond the telescoping body and towards a first body region of a person, wherein the arm comprises an extension segment configured to extend the impact end of the arm;

an impact zone shield coupled to the impact end of the arm and configured to cover the first body region; and at least one body contact coupled with the telescoping body and comprising a contact surface configured to lie against a second body region of the person, wherein the impact zone shield is positioned to receive a blow directed towards the first body region and to transfer at least a portion of force from the blow through the arm and the at least one body contact to the second body region.

2. The impact transfer device of claim 1, wherein the telescoping body comprises at least two segments.

3. The impact transfer device of claim 1, further comprising a base coupled to the second end of the telescoping body.

4. The impact transfer device of claim 3, wherein the base comprises an attachment structure configured to secure the base to the person.

5. The impact transfer device of claim 3, wherein at least one surface of the impact zone shield, the at least one body contact and the base is padded.

6. The impact transfer device of claim 3, wherein the attachment structure comprises a garment.

7. The impact transfer device of claim 1, wherein position and orientation of the arm is adjustable with respect to the telescoping body.

8. The impact transfer device of claim 1, wherein the arm further comprises an extension segment configured to extend the impact end of the arm away from the first body region.

9. The impact transfer device of claim 1, further comprising an attachment structure configured to secure the at least one body contact to the person, wherein the contact surface of each of the at least one body contact faces the person.

10. The impact transfer device of claim 1, further comprising: a trigger configured to generate a signal when the blow is delivered to the impact zone shield; and an impact generator configured to generate a stimulus in response to the signal.

11. The impact transfer device of claim 1, wherein the impact zone shield is configured to be positioned to receive a blow directed to a head and neck region of the person.

12. The impact transfer device of claim 1, wherein the impact zone shield is further configured to be positioned to receive a blow directed to a groin region of the person.

13. The impact transfer device of claim 1, wherein the at least one body contact comprises two body contacts, and wherein each of the body contacts comprises a contact surface configured to be positioned facing a body region below the person's clavicle.

14. The impact transfer device of claim 1, wherein the at least one body contact further distributes the at least a portion of the force to the second body region.

15. An impact transfer device comprising:

a telescoping body with a first end and a second end;

an arm with an impact end extending beyond the telescoping body and towards a first body region of a person, wherein the arm comprises an extension segment configured to extend the impact end of the arm away from the first body region;

an impact zone shield coupled to the impact end of the arm and configured to cover the first body region; and at least one body contact coupled with the telescoping body and comprising a contact surface configured to lie against a second body region of the person, wherein the impact zone shield is positioned to receive a blow directed at the first body region and to transfer at least a portion of force from the blow to the second body region.

16. The impact transfer device of claim 15, further comprising a base coupled to the second end of the telescoping body.

17. The impact transfer device of claim 16, wherein the base comprises an attachment structure configured to secure the base to the person.

18. The impact transfer device of claim 16, wherein at least one surface of the impact zone shield, the at least one body contact and the base is padded.

19. The impact transfer device of claim 15, further comprising: a trigger coupled to the extension segment and the telescoping body and configured to generate a signal when the blow is delivered to the impact zone shield; and an impact generator configured to generate a stimulus in response to the signal.

20. An impact transfer device comprising:

a telescoping body with a first end and a second end, the telescoping body configured to be positioned adjacent to a human torso, wherein the telescoping body further includes an arm at the first end, the arm having an impact end extending beyond the first end of the telescoping body and towards a first body region of a person;

an impact zone shield coupled to the impact end of the arm and configured to cover the first body region;

at least one body contact coupled with the telescoping body and having a contact surface configured to lie against a second body region of the person, wherein the impact zone shield is positioned to receive a blow directed towards the first body region and to transfer at least a portion of force from the blow through the arm and the at least one body contact to the second body region; and an impact generator configured to generate a stimulus in response to a trigger.

* * * * *